US008327835B2

(12) United States Patent
Larsen et al.

(10) Patent No.: US 8,327,835 B2
(45) Date of Patent: Dec. 11, 2012

(54) DOOR LOCKING MECHANISM FOR AN OVEN HAVING FRENCH-STYLE DOORS

(75) Inventors: Christopher A. Larsen, Cleveland, TN (US); David E. Levi, Ringgold, GA (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 12/772,292

(22) Filed: May 3, 2010

(65) Prior Publication Data

US 2010/0206289 A1 Aug. 19, 2010

Related U.S. Application Data

(62) Division of application No. 11/206,218, filed on Aug. 18, 2005, now Pat. No. 7,735,480.

(51) Int. Cl.
*F24C 15/02* (2006.01)

(52) U.S. Cl. ..... 126/197; 126/273 R; 126/190; 126/192; 49/108; 49/113

(58) Field of Classification Search ..... 126/197, 126/273 R, 190, 192; 49/108, 113
See application file for complete search history.

(56) References Cited

U.S. PATENT DOCUMENTS

| | | | | | |
|---|---|---|---|---|---|
| 2,025,480 | A * | 12/1935 | Sponsler | 49/103 |
| 2,601,604 | A * | 6/1952 | Ford | 49/109 |
| 3,436,976 | A * | 4/1969 | Solomon | 74/143 |
| 3,707,145 | A * | 12/1972 | Anetsberger et al. | 126/21 A |
| 4,015,688 | A * | 4/1977 | Mangel | 187/319 |
| 4,069,616 | A * | 1/1978 | Doveinis | 49/103 |
| 5,029,910 | A * | 7/1991 | Genbauffe et al. | 292/110 |
| 6,315,336 | B1 * | 11/2001 | Swartzell | 292/201 |
| 6,966,582 | B1 * | 11/2005 | Malone et al. | 292/95 |

* cited by examiner

*Primary Examiner* — Steven B McAllister
*Assistant Examiner* — Avinash Savani
(74) *Attorney, Agent, or Firm* — Jason S. Burnette; Diederiks & Whitelaw PLC

(57) ABSTRACT

A cooking appliance having first and second oven doors that combine to extend across and close off a frontal opening of a cooking chamber includes a latching mechanism for locking the first and second oven doors in a closed position. The latching mechanism includes a fixed support plate and a motor having an output shaft to which is rotatably mounted an eccentric drive member. Preferably, the motor is fixedly mounted to the support plate. The latching mechanism further includes first and second latch members each having a first end portion pivotally attached to the eccentric drive member extending to a second end portion defining a hook element. When the motor is activated, a guide mechanism directs the second end portions of the first and second latch members to a locking position leading the hook members into engagement with the first and second doors.

9 Claims, 6 Drawing Sheets

DOOR LOCKING MECHANISM FOR AN OVEN HAVING FRENCH-STYLE DOORS

CROSS-REFERENCE TO RELATED APPLICATIONS

This application represents a divisional of U.S. patent application Ser. No. 11/206,218, now U.S. Pat. No. 7,735,480 issued Jun. 15, 2010.

BACKGROUND OF THE INVENTION

1. Field of the Invention

The present invention pertains to the art of cooking appliances and, more particularly, to a door locking mechanism for an oven having French-style doors.

2. Discussion of the Prior Art

Incorporating French-style doors into cooking appliances is well known in the art. An oven employing French-style doors typically includes a linkage system coupled to the doors. The linkage system translates to shift the doors between open and closed positions when either of the doors is operated. While this type of door arrangement does address many shortcomings typically associated with horizontally swinging doors, French-style doors include several shortcomings of their own. For example, proper door sealing to prevent excessive heat loss from the oven cavity is an important concern. In at least arrangements employing doors that interengage when closed, in order for the doors to close and seal properly, one of the doors must lag with respect to the other. In this manner, a proper seal can be maintained about the oven. Moreover, the linkage must hold the doors in the closed position to ensure that hot oven gases do not escape. Other areas of concern include providing a lock or latching mechanism that prevents the doors from being opened, particularly during a self-clean operation.

Certainly latching mechanisms for oven doors, both manual and automatic, are known in the art. In conventional style ovens, automatic latching mechanisms are typically operated by a solenoid or motor that drives a latch into engagement with the oven door. Other forms of latching mechanisms, typically employed with French-style doors, cooperate with the linkage system to prevent the doors from opening While effective, latching mechanisms of this type can be overly complex and are often bulky. Bulky systems are difficult to incorporate into ovens having minimal available space for controls or other hardware.

Based on the above, there exists a need for an automatic latching mechanism for an oven having French-style doors. More specifically, there exists a need for a simple, low profile, automatic latching mechanism that can be incorporated into an oven having French-style doors and minimal available space for controls and other hardware.

SUMMARY OF THE INVENTION

The present invention is directed to a latching mechanism for a cooking appliance having first and second doors that combine to extend across and close off a frontal opening of a cooking chamber. In accordance with the invention, the latching mechanism includes a support plate and a motor having an output shaft to which is rotatably mounted an eccentric drive member. Preferably, the motor is fixedly mounted to the support plate which, in turn, is fixed relative to the cooking chamber.

The latching mechanism further includes first and second latch members operatively connected to the motor. More specifically, each of the first and second latch members includes a first end portion pivotally attached to the eccentric drive member, a second end portion defining a hook element and an intermediate portion extending between the first and second end portions. When the motor is activated, a guide mechanism, that can be mounted to either the support plate or the first and second latch members, causes the second end portions of the latch members to be drawn together.

In accordance with the most preferred form of the invention, the guide mechanism is constituted by first and second cam members that cooperate with corresponding first and second camming surfaces to shift the second end portions together. Preferably, the first and second cam members are mounted to corresponding ones of the first and second latch members, with the camming surfaces being formed in the support plate. That is, the support plate includes first and second openings each having an associated contour that defines a respective camming surface. With this arrangement, when the motor is activated, the eccentric drive member shifts the first end portions of the first and second latch members about an eccentric axis. As the first end portions rotate, the cam members cooperate with the camming surfaces to cause the second end portions of the latch members to shift to a locking position, with the hook members engaging the first and second doors.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
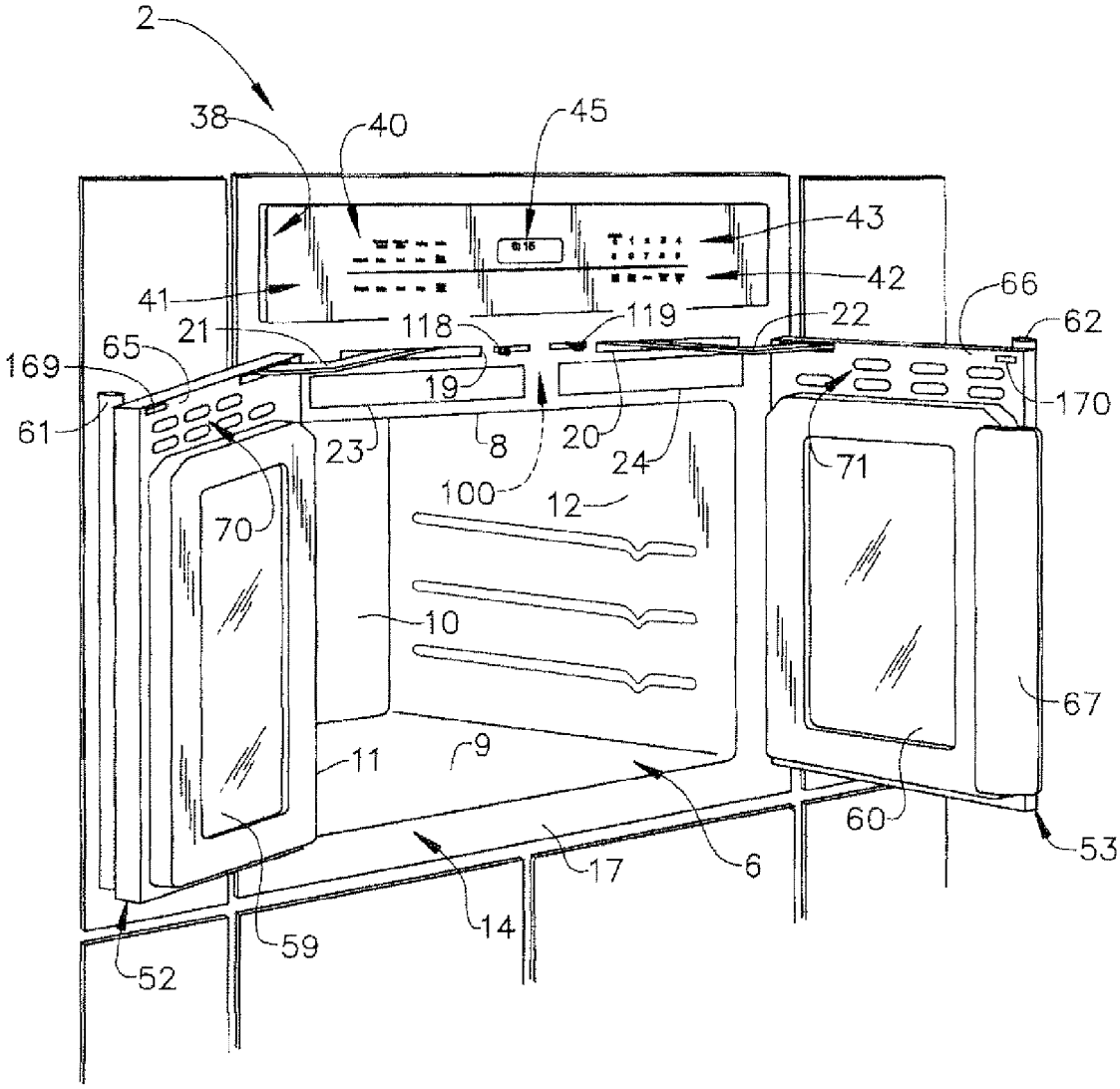
FIG. 1 is an upper right perspective view of a wall oven having left and right French-style doors incorporating a door locking mechanism constructed in accordance with the present invention.
Figure 2:
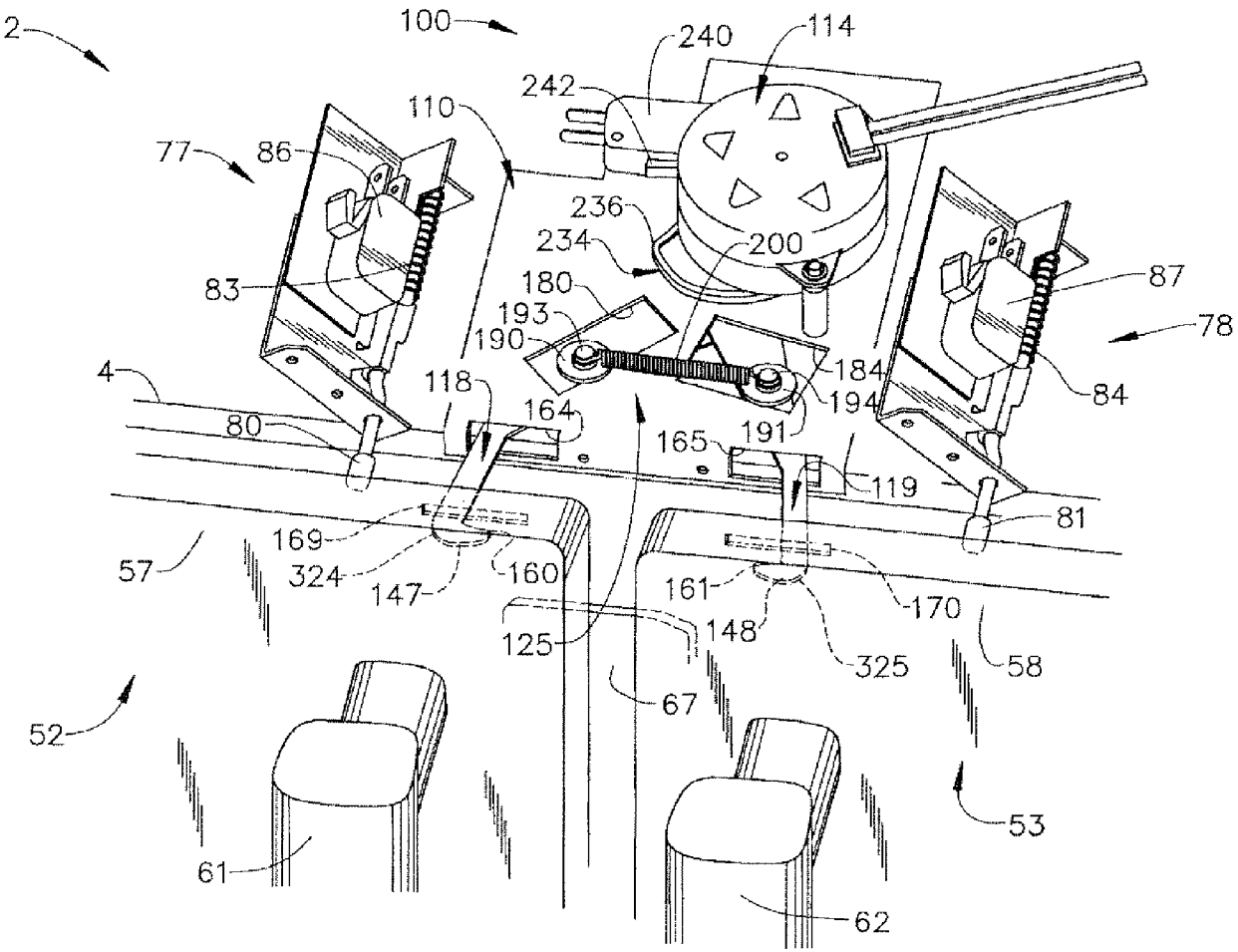
FIG. 2 is an upper perspective view of the locking mechanism constructed in accordance with the present invention shown in an unlocked state.

With initial reference to FIGS. 1 and 2, a cooking appliance constructed in accordance with the present invention is generally indicated at 2. As depicted, cooking appliance 2 constitutes a wall oven. However, it should be understood that the present invention is not limited to this particular model type and can be incorporated into various types of oven configurations, e.g., cabinet mounted ovens, as well as both slide-in and free-standing ranges. In any event, in the embodiment shown, cooking appliance 2 constitutes a single wall oven unit including a frame 4 (see FIG. 2) that supports, at least in part, an oven cavity 6. Oven cavity 6 includes a top wall 8, a bottom wall 9, a rear wall 10 and opposing side walls 11 and 12 that collectively define a frontal opening 14. In a manner known in the art, frontal opening 14 is surrounded by a face frame portion 17 which provides an overall aesthetic finish to cooking appliance 2. Preferably, face frame portion 17 is provided with first and second openings 19 and 20 which define a passage for portions of a linkage system, particularly door control arms 21 and 22 of the door linkage system. As the actual construction of the door linkage system does not form part of the present invention additional details will not be provided. A more detailed description of the door linkage system can be found in commonly assigned U.S. patent application entitled "Door Linkage System For an Oven Having French-Style Doors" filed on even date herewith and incorporated by reference. In any event, face frame portion 17 is also provided with additional openings 23 and 24 that form part of an overall airflow system for cooking appliance 2.

In a manner known in the art, cooking appliance 2 includes a control panel 38 having a plurality of control elements. In accordance with the embodiment shown, the control elements are constituted by first, second and third sets of oven control buttons 40-42, as well as a numeric pad 43. Control panel 38 is adapted to be used to input desired cooking parameters and operating conditions for cooking appliance 2. More specifically, first, second and third sets of control buttons 40-42, in combination with numeric pad 43 and a display 45, enable a user to establish particular cooking operations that are performed within oven cavity 6. As the oven control is known in the art and not part of the present invention, it will not be discussed further herein.

In accordance with the invention, cooking appliance 2 is provided with French-style doors that are adapted to selectively seal across frontal opening 14. More specifically, cooking appliance 2 includes a first door 52 and a second door 53 that are pivotally mounted relative to frame 4 and adapted to be moved from a fully closed position, as represented in FIG. 2, to a fully open position, as represented in FIG. 1, to provide access to oven cavity 6. As shown, doors 52 and 53 swing outward about substantially vertical axes established by upper and lower hinges (not shown).

In a manner known in the art, each door 52, 53 is provided with a corresponding outer panel 57, 58 having a respective central transparent zone or window 59, 60. In addition, each door 52, 53 is provided with a corresponding handle 61, 62 that enables a consumer to shift doors 52 and 53 between open and closed positions. In order to provide a proper seal about frontal opening 14, each door 52, 53 includes an inner panel 65, 66 about which extends a peripheral seal (not shown). In addition, second door 53 is provided with a flange 67 that serves as an intermediate sealing surface for first door 52. That is, when both first and second doors 52 and 53 are moved to the closed position of FIG. 2, flange 67 traverses an intermediate gap or opening (not separately labeled) present between doors 52 and 53.

Although not part of the present invention, doors 52 and 53 are shown to include a plurality of openings indicated generally at 70 and 71 on inner panels 65 and 66. Openings 70 and 71 allow an airflow to pass through doors 52 and 53 into openings 23 and 24 and around oven cavity 6. The airflow ensures that heat in oven cavity 6 does not conduct from oven cavity 6 through to outer panels 57 and 58 of doors 52 and 53. In addition, cooking appliance 2 is shown in FIG. 2 to include a pair of door position sensors 77 and 78. Each door position sensor 77, 78 includes a corresponding plunger 80, 81 that is operatively biased outward by a respective spring 83, 84 and switch 86, 87. With this arrangement, when doors 52 and 53 are closed, inner panels 65 and 66 contact plungers 80 and 81. Plungers 80 and 81 retract against the force applied by springs 83 and 84, thereby changing the state of switches 86 and 87. The change in state of switches 86 and 87 signals an oven control (not shown) that doors 52 and 53 are closed. In accordance with one aspect of the invention, switches 86 and 87 must be closed before the oven control can lock doors 52 and 53 for a self-clean operation. However, switches 86 and 87 can also control an oven light (not shown) when, for example, oven cavity 6 is below a predetermined temperature, e.g., approximately 600° F. (315.6° C.).

In accordance with the invention, cooking appliance 2 includes a lock mechanism 100 for selectively securing doors 52 and 53, particularly during a pyrolitic self-clean operation in oven cavity 6. Referring to FIGS. 2-6, locking mechanism 100 includes a support plate 110 fixedly secured to frame 4, a motor 114, first and second latch members 118 and 119 and at least one guide mechanism, illustrated generally at 125. As will more discussed fully below, locking mechanism 100 interacts with doors 52 and 53 to prevent a consumer from inadvertently accessing oven cavity 6 when cooking appliance 2 is in operation, particularly during a self-clean operation.

Figure 3:
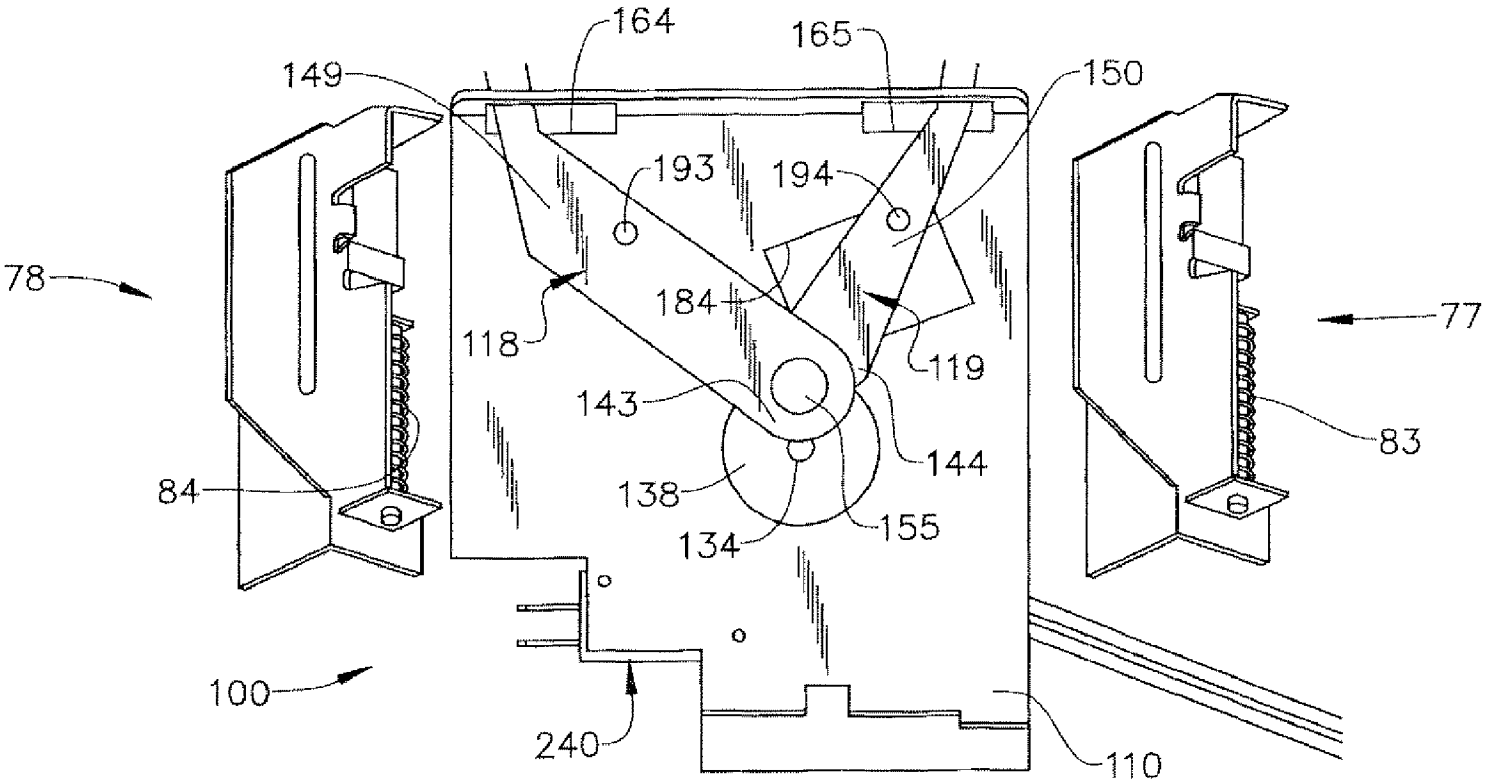
FIG. 3 is a lower detailed view of the locking mechanism of FIG. 2.

Motor 114 includes an output shaft 134 having attached thereto a first eccentric drive member 138 which, in turn, is coupled to latch members 118 and 119 as best shown in FIG. 3. Latch members 118 and 119 are preferably secured or mounted to first eccentric drive member 138 at a position off-set from output shaft 134. More specifically, each latch member 118, 119 includes a respective first end 143, 144 that extends to a second end 147, 148 (FIGS. 2 and 4-6) through a corresponding intermediate portion 149 and 150. First ends 143 and 144 of latch members 118 and 119 are interconnected by a pivot pin 155 which is attached to first eccentric drive member 138 at a position offset from output shaft 134. As best shown in FIG. 2, second ends 147 and 148 of latch members 118 and 119 are provided with hook elements 160 and 161 which, in a manner that will be discussed more fully below, are employed to engage doors 52 and 53 respectively. That is, second ends 147 and 148 extend through openings 164 and 165 in support plate 110 and, when doors 52 and 53 are closed, through both corresponding openings (not separately labeled) in face frame portion 17 and latch receiving apertures 169 and 170 formed in inner panels 65 and 66.

In accordance with the most preferred form of the invention, guide mechanism 125 is constituted, in part, by a first opening formed in support plate 110 that defines a first, generally rectangular camming surface 180 and a second opening that defines a second, generally rectangular camming surface 184. First and second camming surfaces 180 and 184 cooperate with corresponding first and second cam members 190 and 191. Cam members 190 and 191 are rotatably mounted to intermediate portions 149 and 150 of latch members 118 and 119 respectively. In the embodiment shown, first and second cam members 190 and 191 are secured to latch members 118 and 119 through a pair of pins 193 and 194 that enable first and second cam members 190 and 191 to rotate freely when traversing camming surfaces 180 and 184. In order to ensure proper operation of guide mechanism 125, first and second cam members 190, 191 are coupled through a spring element 200. As will be detailed more fully below, spring element 200 ensures that cam members 190, 191 properly ride along camming surfaces 180 and 184 when motor 114 is activated.

In further accordance with the most preferred form of the invention, locking mechanism 100 includes a second eccentric drive member 234 mounted for rotation with output shaft 134 of motor 114. Second eccentric drive member 234 includes a lobe portion 236 that, as motor 114 moves latch members 118 and 119 into a locked configuration, cooperates with a lock position switch 240 mounted to support plate 110. More specifically, as motor 114 rotates eccentric drive member 138 to lock doors 52 and 53, second eccentric drive member 234 is also rotated. Once locking mechanism 100 is in a fully locked position (FIG. 6), lobe 236 depresses an actuation arm 242 of lock position switch 240. Once activation arm 242 is depressed, lock position switch 240 changes state, signaling that locking mechanism 100 is in a fully locked position and enabling the oven control to initiate, for example, a self-cleaning operation. In any event, having described a preferred construction of locking mechanism 100, reference will now be made to FIGS. 2-6 in describing a preferred method of operation.

Figure 4:
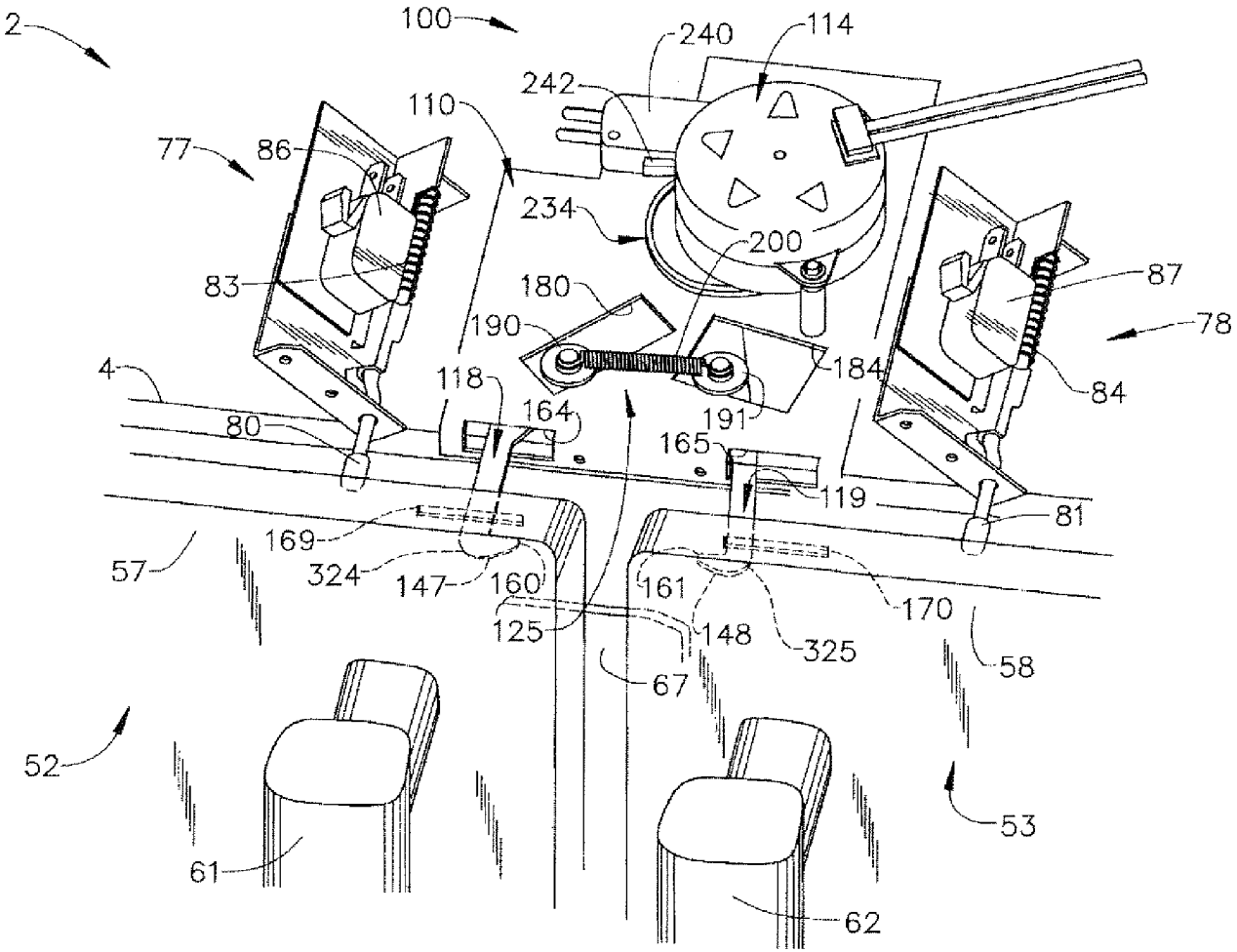
FIG. 4 is an upper perspective view of the locking mechanism of FIG. 2 shown with the right door in a locked state.
Figure 5:
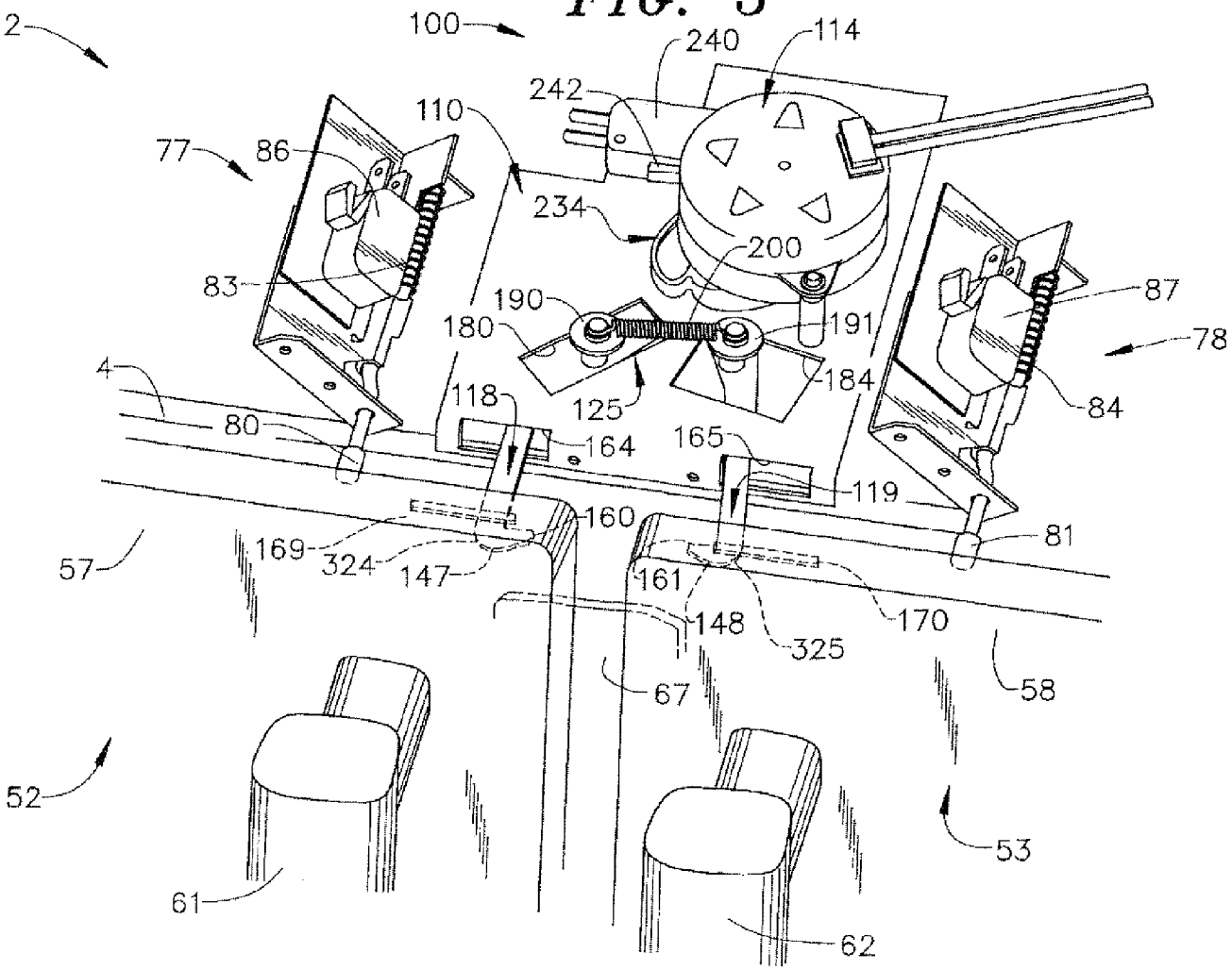
FIG. 5 is a view of the locking mechanism, similar to FIG. 4, shown with the right door in a locked state and the left door in a partially locked state.
Figure 6:
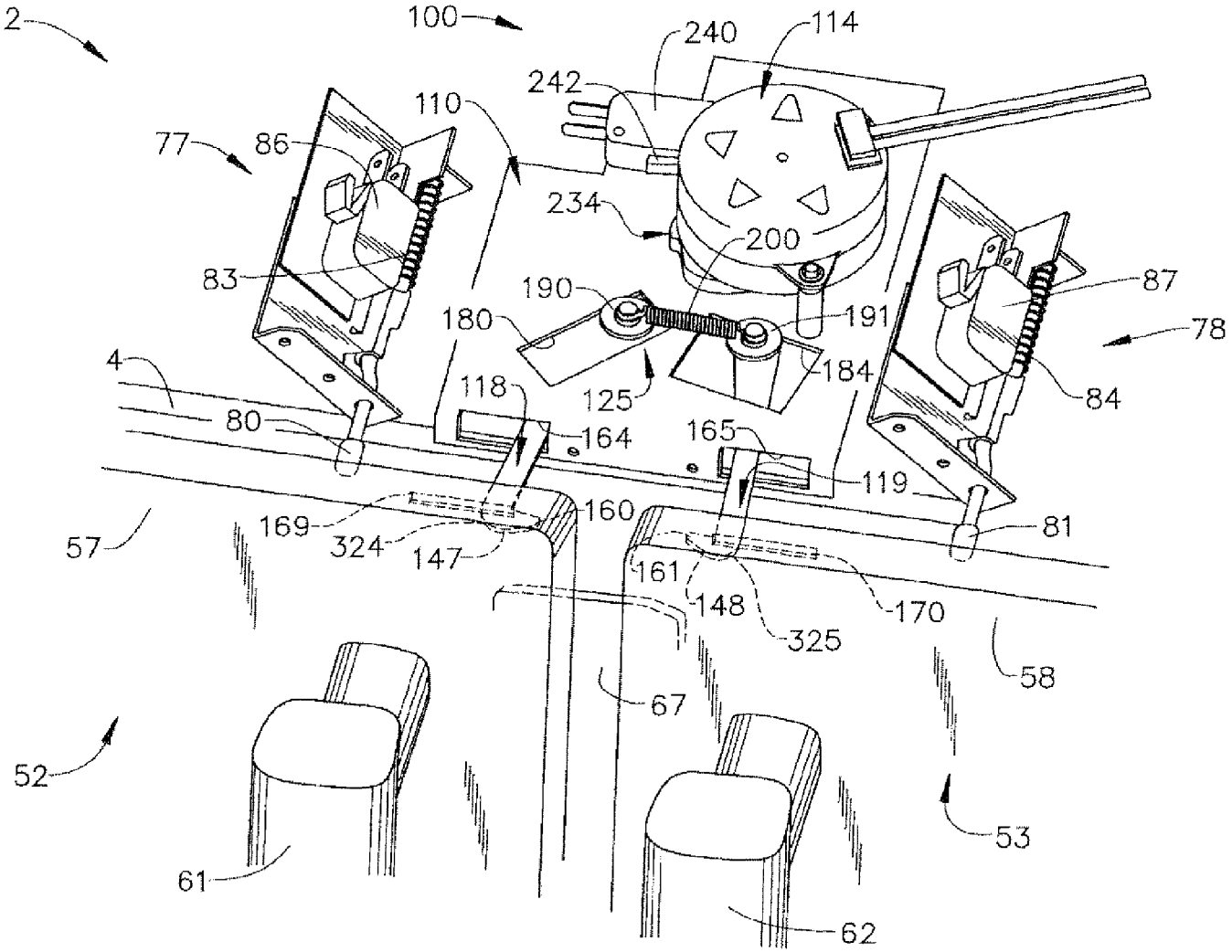
FIG. 6 illustrates the locking mechanism with both the left and right doors in a fully locked state.

By default, locking mechanism 100 is in an unlocked state as represented in FIG. 2. That is, while latch members 118 and 119 extend into doors 52 and 53, guide mechanism 125 forces hook elements 160 and 161 to remain separated so as not to engage with inner panel portions 65 and 66, thereby allowing doors 52 and 53 to be freely opened and closed. However, once locking mechanism 100 is activated through, for example, a select one or combination of control elements 41-43 or by implementing a self-clean mode, hook elements 160 and 161 are brought together to engage inner panel portions 65 and 66 to prevent doors 52 and 53 from being opened. Upon initial activation of locking mechanism 100, motor 114 rotates output shaft 134 which, in turn, rotates eccentric drive member 138. Initial rotation of eccentric drive member 138 pivots latch members 118 and 119 about an arcuate path causing cam member 191 to travel along camming surface 184. As cam member 191 transitions across camming surface 184, latch member 119 moves into a position wherein second end 148 reaches a terminal end of latch receiving apertures 170, with hook element 161 projecting past inner panel 66 as shown in FIG. 4. As lock mechanism 100 continues to close, cam members 190 and 191 cause latching members 118 and 119 to move together. More specifically, spring 200 maintains a force on latching members 118 and 119 such that, as cam members 190 and 191 transition along camming surfaces 180 and 184, latching members 118 and 119 are pulled toward one another.

When latching members 118 and 119 contact inner panels 65 and 66, cam members 190 and 191 lose contact with camming surfaces 180 and 184 and mid-portions (not separately labeled) of latching members 118 and 119 slide against sides (not labeled) of openings 169 and 170. At this point, hook elements 160 and 161 engage respective hook receiving sections of inner panels 65 and 66 and continue to draw doors 52 and 53 inward. At a final phase of rotation of output shaft 134, latch member 118 is drawn inward, thereby pulling hook element 160 tightly against inner panel 65 (FIG. 6) causing door 53 to seat against frame portion 17 to ensure a proper seal about frontal opening 14. At approximately the same time, lobe 236 of second eccentric drive member 234 contacts and presses actuation arm 242, changing the position of switch 240. Switch 240 then signals the oven control that doors 52 and 53 are fully locked and motor 114 is stopped. At this point, a heating operation, particularly a self-cleaning operation, can be carried out in oven cavity 6. Upon completion of the operation, a consumer may enter a sequence of one or more control inputs through control elements 41-43 to open locking mechanism 100. Alternatively, cooking appliance 2 can simply signal motor 114 to automatically open locking mechanism 100 at the termination of the heating operation based on a sufficient reduction in oven cavity temperature.

In any event, locking mechanism 100 releases doors 52 and 53 by simply re-activating motor 114 to cause output shaft 134 to rotate an additional 180°, with cams 180 and 184 separating latch members 118 and 119, and causing hook elements 160 and 161 to disengage from doors 52 and 53 so as to re-assume the position of FIG. 2. More specifically, during initial rotation of output shaft 134, hook elements 160 and 161 maintain contact with doors 52 and 53. However, continued rotation of output shaft 134 causes cam members 180 and 184 to separate latching members 118 and 119 allowing doors 52 and 53 to shift slightly outward to a natural balance position. Motor 114 continues to rotate output shaft 134 until lobe 236 disengages from switch 240 signaling that doors 52 and 53 are fully unlocked.

Although described with reference to a preferred embodiment of the invention, it should be readily understood that various changes and/or modifications can be made to the invention without departing from the spirit thereof. In general, the invention is only intended to be limited by the scope of the following claims.

We claim:

1. A method of locking first and second doors that combine to extend across and close off a frontal opening of an oven cavity of a cooking appliance comprising:

activating a motor, mounted to a support plate, to cause rotation of an output shaft of the motor in a first direction, said output shaft being coupled to first end portions of first and second latch members through an eccentric drive member;

shifting second end portions of the first and second latch members to a locking position through rotation of the eccentric drive member, said second end portions of the first and second latch members including corresponding first and second hook elements;

engaging the first and second hook elements with respective hook receiving sections of the first and second doors; and drawing the first and second doors against a frame formed about the frontal opening of the cooking appliance.

2. The method of claim 1, further comprising: guiding first and second cam members across corresponding camming surfaces to shift the second end portions of the first and second latch members to the locking position.

3. The method of claim 1, further comprising: biasing the first and second latch members towards one another through a spring during operation of the motor.

4. The method of claim 1, further comprising: activating a switch when the first and second doors are in the locking position.

5. The method of claim 1, further comprising:

rotating another eccentric drive member including a lobe; and activating a door position switch by guiding the lobe into contact with an actuation arm of the door position switch.

6. The method of claim 1, wherein the first hook element engages the first door prior to the second hook element engaging the second door.

7. The method of claim 1, wherein drawing the first and second doors against the frame includes shifting the first and second latch members rearward.

8. The method of claim 1, wherein the output shaft rotates the eccentric drive member which is directly coupled to at least one of the first and second latch members.

9. A method of locking first and second doors that are mounted for pivotal movement relative to and combine to extend across and close off a frontal opening of an oven cavity of a cooking appliance comprising:

activating a motor, mounted to a support plate, to cause rotation of an output shaft of the motor in a first direction, said output shaft being coupled to first end portions of first and second latch members through an eccentric drive member;

shifting second end portions of the first and second latch members to a locking position through rotation of the eccentric drive member, said second end portions of the first and second latch members including corresponding first and second hook elements;

engaging the first and second hook elements with respective hook receiving sections of the first and second doors; and drawing the first and second doors against a frame formed about the frontal opening of the cooking appliance through pivotal movement of the first and second doors relative to the oven cavity.

* * * * *